US005312232A

United States Patent [19]

Horton et al.

[11] Patent Number: 5,312,232

[45] Date of Patent: May 17, 1994

[54] PUMP FOR MOLTEN METAL OR OTHER FLUID

[75] Inventors: James A. Horton; Donald L. Brown, both of Livermore, Calif.

[73] Assignee: The United States of America as represented by the United States Department of Energy, Washington, D.C.

[21] Appl. No.: 67,910

[22] Filed: May 27, 1993

[51] Int. Cl.[5] ..... F04F 1/18

[52] U.S. Cl. ..... 417/108

[58] Field of Search ..... 417/108, 90

[56] References Cited

U.S. PATENT DOCUMENTS

| | | | |
|---|---|---|---|
| 827,341 | 7/1906 | Young et al. | 417/108 |
| 1,741,571 | 12/1929 | Ives | 417/108 |
| 2,399,634 | 5/1946 | Holland et al. | 417/108 X |
| 3,289,609 | 12/1966 | Palo | 417/108 X |

OTHER PUBLICATIONS

A. H. Stenning, C. B. Martin, "An Analytical and Experimental Study of Air-Lift Pump Performance," *Journal of Engineering or Power*, Apr. 1968, pp. 106-110.

*McGraw-Hill Encyclopedia of Science & Technology*, "Electromagnetic pumps," 6th Edition, Copyright 1987, 1982, 1977, 1971, 1966 & 1960, 4 pages in length, see p. 153.

*Primary Examiner*—Richard E. Gluck

*Attorney, Agent, or Firm*—Miguel A. Valdes; Roger S. Gaither; William R. Moser

[57] ABSTRACT

A pump having no moving parts which can be used to pump high temperature molten metal or other fluids in a vacuum or low pressure environment, and a method for pumping such fluids. The pump combines elements of a bubble pump with a trap which isolates the vacuum or low pressure region from the gas used to create the bubbles. When used in a vacuum the trap prevents the pumping gas from escaping into the isolated region and thereby reducing the quality of the vacuum. The pump includes a channel in which a pumping gas is forced under pressure into a cavity where bubbles are formed. The cavity is in contact with a reservoir which contains the molten metal or other fluid which is to be pumped. The bubbles rise up into a column (or pump tube) carrying the fluid with them. At the top of the column is located a deflector which causes the bubbles to burst and the drops of pumped fluid to fall into a trap. The fluid accumulates in the trap, eventually forcing its way to an outlet. A roughing pump can be used to withdraw the pumping gas from the top of the column and assist with maintaining the vacuum or low pressure environment.

7 Claims, 1 Drawing Sheet

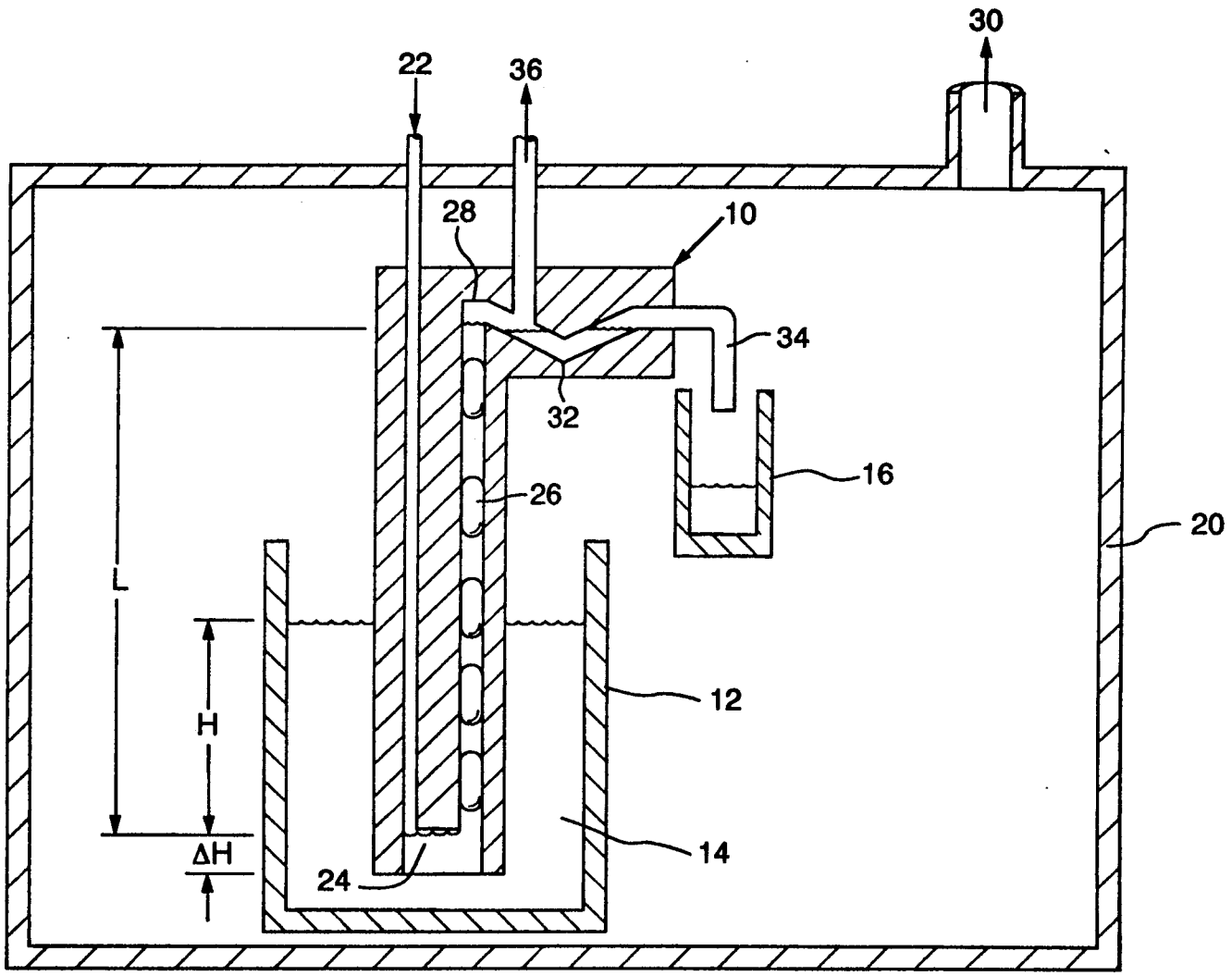
20
30
16
34
10
12
14
36
32
26
28
22
24
H
ΔH
L

PUMP FOR MOLTEN METAL OR OTHER FLUID

The U.S. Government has rights to this invention pursuant to Contract No. W-7405-ENG-48 between the U.S. Department of Energy and the University of California, for the operation of the Lawrence Livermore National Laboratory.

TECHNICAL FIELD

The present invention is generally directed to pumps used to move fluids from one location to another, and more specifically, to an apparatus and method for pumping high temperature molten metal or other fluids in a vacuum or low pressure environment using a pump having no moving parts.

BACKGROUND OF THE INVENTION

Various types of pumps are commonly used to pump fluids from one location to another. Liquid metal, or another fluid of sufficiently high electrical conductivity, can be pumped by means of an electromagnetic (EM) pump. A description of the theory behind and applications of such pumps can be found in the McGraw-Hill Encyclopedia of Science & Technology, 6th Edition, Volume 6, pages 153–54, published by McGraw-Hill, Inc. EM pumps are based on the principle that a force is exerted on a current-carrying conductor when it is placed in a magnetic field. There are several types of EM pumps, with the various designs being differentiated by the character of the current (direct or alternating current) and magnetic field used, and the method used to cause current to flow within the pumped fluid.

One of the most common types of EM pumps is termed a conduction pump, which may be of either the direct current (dc) or alternating current (ac) variety. A dc conduction EM pump consists of a pump duct or conduit through which flows a conductive fluid (such as molten metal) and across which is applied a magnetic field in a direction perpendicular to the desired direction of fluid flow. The magnetic field may be produced by either a permanent magnet or an electromagnet. Electrodes are arranged such that they form a path for current to be conducted through the fluid in a direction perpendicular to both the desired direction of fluid flow and the direction of the magnetic field. The relationship between the current, magnetic field, and intended direction of fluid flow subjects the fluid to a force which acts to pump it through the conduit (where the incremental force dF is given by $dF = I\, dl \times B$, where dl is the increment of length of the current path in the fluid and B is the magnetic field).

The physical arrangement of the elements in such a pump allows only a single passage of current between the electrodes, resulting in the existence of a relatively short length for the current path within the fluid. To compensate for this situation, and to increase the force exerted on the fluid, very high currents (typically thousands of amperes) at low voltages (typically less than 1 volt) are used. The high currents can result in the production of heat due to the $I^2R$ power dissipation occurring within the conducting fluid. This situation, and the need to protect the magnet from the fluid, which itself may be at a high temperature, means that the magnet is usually both electrically and thermally insulated from the conduit.

Standard EM pumps have several advantages over mechanical pumps. The absence of moving parts within the pumped fluid means that seals or bearings are not needed. This minimizes required maintenance and improves reliability. EM pumps can also operate in a vacuum, something that some mechanical pumps are not capable of doing.

However, EM pumps also have several disadvantages. Because the conduit is often relatively flat in order to increase the magnitude of the force applied to the conducting fluid, such pumps are prone to becoming obstructed. The magnet used to create the magnetic field must be close in proximity to the conduit and electrically and thermally insulated from it. This makes the pump bulkier and complicates its design and fabrication. EM pumps also require a power supply to provide the conduction current and may require an additional power supply if an electromagnet is used to produce the magnetic field.

In addition, although EM pumps are capable of pumping large volumes of fluid (hundreds to thousands of gallons per minute), because such pumps are sensitive to the head depth of the pump, they are not as easily used to pump small amounts or to regulate the rate at which fluid is pumped. This can be a disadvantage in circumstances where it is important to be able to precisely control the amount of fluid which is pumped, or to obtain a highly reproducible pump rate. Finally, the fluid which is to be pumped must have a sufficiently high electrical conductivity in order for the pump to be effective. This limits the applications for which the pump is suited.

Another type of pump which can be used to pump fluids is a bubble or air-lift pump. This type of pump uses gas (typically air) forced under pressure into a cavity to create a stream of bubbles, which carry liquid with them as they rise up a pump tube. A theoretical analysis of the performance of air-lift pumps is contained in the article "An Analytical and Experimental Study of Air-Lift Pump Performance", by A. H. Stenning and C. B. Martin, published in Transactions of the ASME, Journal of Engineering for Power, pp. 106–110, April 1968.

Air-lift or bubble pumps are commonly used for purposes of underwater exploration and mining. However, standard bubble pumps are not suitable for pumping fluids in a vacuum because as the bubbles burst, the quality of the vacuum will be reduced. This limits the usefulness of bubble pumps, as it is desirable to pump fluids such as liquid metal in a vacuum in order to reduce the reactivity of the molten metal. Pumping molten metal in a vacuum serves to lessen damage to the pump and limits chemical reactions involving the metal which may reduce its usefulness for the purpose for which it is intended.

What is desired is an apparatus and method for pumping high temperature molten metal or other fluids in a vacuum or low pressure environment, which is not subject to the disadvantages of pumps currently used for such purposes.

SUMMARY OF THE INVENTION

The present invention is directed to a pump having no moving parts which can be used to pump high temperature molten metal or other fluids in a vacuum or low pressure environment, and to a method for pumping such fluids. The pump combines some elements of a bubble pump with a trap which isolates the vacuum or low pressure region from the gas used to create the bubbles. When used in a vacuum the trap prevents the pumping gas from escaping into the isolated region and reducing the quality of the vacuum.

The pump includes a channel which allows a pumping gas to be forced under pressure into a cavity where bubbles are formed. The cavity is in contact with a reservoir which contains the molten metal or other fluid which is to be pumped. The bubbles rise up into a column (or pump tube) carrying a portion of the fluid with them. At the top of the column is located a deflector which causes the bubbles to burst and the drops of pumped fluid to fall into a trap, which may be nothing more than a "u" or "v" shaped piece of tubing. The fluid accumulates in the trap, eventually forcing its way to an outlet. A roughing pump is used to withdraw the pumping gas from the top of the column as a means of assisting with the proper functioning of the pump and maintaining the vacuum or low pressure environment.

Further objects and advantages of the present invention will become apparent from the following detailed description and accompanying drawing.

BRIEF DESCRIPTION OF THE DRAWING

FIG. 1 is a cut-away view showing the structure of the molten metal pump of the present invention.

DESCRIPTION OF THE PREFERRED EMBODIMENT

Referring to FIG. 1, there is shown a cut-away view of a molten metal pump 10 of the present invention. As depicted in FIG. 1, pump 10 is situated in an operating chamber 20 in which is contained a reservoir 12, which holds a source of molten metal or other fluid 14. Operating chamber 20 may be maintained at a vacuum or at a desired operating pressure by means of inlet 30, to which may be attached a vacuum pump (not shown).

Pump 10 is intended to pump molten metal or other fluid 14 from reservoir 12 into receiving container 16, or if desired, to another selected location. Pump 10 includes gas channel 22 through which is pumped gas from a source of gas (not shown). Gas pumped through channel 22 flows into pump 10, eventually reaching cavity 24 which is in contact with molten metal or other fluid 14 contained in reservoir 12.

As the gas pumped through channel 22 enters cavity 24 it forms bubbles which rise up pump tube 26. As the bubbles rise up pump tube 26 they carry with them a portion of the fluid 14 contained in reservoir 12. Therefore, those portions of pump 10 which will come into contact with fluid 14 during the operation of pump 10 should be constructed of a material which is non-reactive or highly resistant to chemical attack by fluid 14. As the bubbles and fluid reach the top of pump tube 26 the bubbles burst upon impact with deflector 28, which may be nothing more than the top corner of pump tube 26. That portion of fluid 14 raised up pump tube 26 by the bubbles then falls into trap 32.

Trap 32 has two functions; to collect the raised fluid and to isolate the operating environment within chamber 20 from the gas injected into channel 22 which has risen up pump tube 26. This prevents the bubbles of gas which rise up pump tube 26 from impacting the vacuum or low pressure environment maintained within chamber 20. Trap 32 may be nothing more than a "u" or "v" shaped piece of tubing constructed of the same material as pump tube 26. The advantage of a "v" shaped trap is that it may be easier to fabricate. Note that trap 32 as it is depicted in FIG. 1 is shallower than a realistic trap would probably be. As discussed later, the appropriate depth of trap 32 depends on the operating conditions of pump 10.

Inlet 36 can be used to withdraw the pumping gas from the top of pump tube 26 as a means of assisting with the proper functioning of pump 10 and maintaining the operating environment within chamber 20. A roughing pump (not shown) may be attached to inlet 36 so as to reduce the pressure at inlet 36 by an amount sufficient to allow the gas pumped through channel 22 which rises up pump tube 26 to be withdrawn through inlet 36. This will prevent the gas from being blown out the end of trap 32 and interfering with the proper functioning of pump 10. As the pumped fluid collects in trap 32 it is forced through outlet tube 34 from which it may be collected in receiving container 16. The pump of the present invention may be used to pump a suitable fluid into an environment which is maintained at a pressure which is lower than the vapor pressure of the fluid.

Also indicated in FIG. 1 are the dimensions H and L. The dimension H refers to the submergence of the pump, i.e., the depth of cavity 24 below the surface of molten metal or other fluid 14. The dimension L refers to the height of the pump. This is the distance over which fluid 14 is raised by the combined action of pump 10 and the pressure exerted by that portion of fluid 14 which is outside pump tube 26. The pumping rate of pump 10 is found to depend on the quantity (L−H), which is termed the pump head.

The gas which is pumped through channel 22 must be under sufficient pressure to overcome the submergence of the pump, H. However, the pressure should be less than that exerted by the amount of fluid 14 contained in a column of height $H+\Delta H$ (this pressure is $P_f g(H+\Delta H)$, where $P_f$ is the density of fluid 14 and g is the acceleration due to gravity). If the pressure under which the gas is injected into channel 22 is greater than $P_f g(H+\Delta H)$, the gas will blow out into cavity 24 and the pump rate will approach zero.

The rate at which fluid 14 is pumped by pump 10 is approximately equal to the rate at which the pumping gas is injected into gas channel 22. A metering valve (not shown) may be placed upstream of the entry to gas channel 22 in order to permit control of the rate (expressed in terms of volume/time) at which the pumping gas is injected into gas channel 22. Adjustment of the metering valve will then allow careful metering of the rate, and hence the amount, of fluid pumped.

In accordance with these principles, an example of molten metal pump 10 of the present invention has been constructed by the inventors. The example pump was fabricated from hafnium carbide, although it may also be fabricated from materials such as alumina. As mentioned, the material from which pump 10 is fabricated should be non-reactive or highly resistant to attack from the fluid which is pumped. Those portions of pump 10 not in contact with the fluid can be fabricated from other materials, such as stainless steel. Pump 10 should also be composed of a material which retains its structural rigidity over the temperature range at which it is designed to operate (which will usually depend on the temperature range at which the material to be pumped is in a fluid state).

Gas channel 22 was fabricated so as to have a circular cross section with a diameter of between one-sixteenth (1/16) and one-eighth (⅛) of an inch. It is important that this diameter not be too small, as otherwise it may be necessary to use a gas which is under high pressure in order to clear channel 22 of any bubbles which form in it. Pump tube 26 also has a circular cross section with a diameter of between one-eighth ($\frac{1}{8}$) and three-eighths ($\frac{3}{8}$) of an inch. The example pump has been used by the inventors to pump mercury at a flow rate of between 10 and 30 cc per minute (depending on the value of L−H, which was varied between 22 and 25 cm) when used in conjunction with Argon as the gas source.

In the example pump, Argon was injected into gas channel 22 at a rate of 15 cc per minute. Any gas compatible with the fluid being pumped may be used as the pumping gas, as long as the gas is inert or nonreactive with the fluid to be pumped. The gas rising up pump tube 26 is withdrawn through inlet 36 by means of a roughing pump which operates at a pressure of approximately one-hundredth (1/100) of an atmosphere. The roughing pump should maintain a pressure at inlet 36 which is less than the pressure exerted by the amount of fluid 14 contained in a column whose height is equal to the depth of trap 32 (this pressure is $P_f g H_D$, where $H_D$ is equal to the depth of the trap). This will prevent the pumping gas from blowing out the end of trap 32.

By varying the flow rate at which gas is injected into gas channel 22 the rate at which fluid 14 is pumped may be varied. This can be useful in situations in which it is desired to carefully meter the amount of fluid pumped, or the rate at which it is pumped.

The present invention provides a pump which can be used to pump a high temperature fluid in a vacuum or low pressure environment. The pump is compact, simple in design and provides an efficient means for pumping small quantities of fluid (on the order of a liter per minute). The pump has no moving parts and is operable over a wide range of pump sizes and operating conditions.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

We claim:

1. A pump for pumping a fluid supplied by a fluid source, which is at subatmosphere conditions, from an inlet to an outlet, the pump comprising:

a pump housing having an inlet at one end, the inlet being open to and in contact with the source of the fluid;

a channel within the pump housing through which gas may be injected into the inlet, the channel having one end open to the pump housing inlet and another end open to the outside of the housing;

a pump tube having two ends through which the fluid may be pumped within the housing, the pump tube being isolated from the channel and having a first end open to the inlet and a second end isolated from the pump outlet; and a trap having two ends which isolates the pump tube from the pump outlet and in which the pumped fluid accumulates, the trap being connected at one end to the second end of the pump tube and at the other end to the outlet, said pump and said source being located within a chamber maintained at subatmospheric pressure.

2. The pump of claim 1, further comprising:

means for removing gas injected into the pump tube from the channel.

3. The pump of claim 1, further comprising:

means for controlling the flow rate of the gas injected into the channel.

4. The pump of claim 1, wherein the gas injected into the channel is Argon.

5. The pump of claim 1, wherein the pumped fluid is a molten metal.

6. The pump of claim 1, wherein the pumped fluid is a molten salt.

7. The pump of claim 1, wherein said trap is v-shaped.

* * * * *